US006213830B1

(12) United States Patent
Robinson

(10) Patent No.: US 6,213,830 B1
(45) Date of Patent: Apr. 10, 2001

(54) STAND-UP AQUATIC DEVICE

(76) Inventor: Walter L. Robinson, 1929 Providence Rd., Lakeland, FL (US) 33805

( * ) Notice: Subject to any disclaimer, the term of this patent is extended or adjusted under 35 U.S.C. 154(b) by 0 days.

(21) Appl. No.: 09/491,013

(22) Filed: Jan. 25, 2000

(51) Int. Cl.[7] ..... B63B 1/00
(52) U.S. Cl. ..... 441/65
(58) Field of Search ..... 441/65, 68, 73, 441/76, 77

(56) References Cited

U.S. PATENT DOCUMENTS

| | | | | |
|---|---|---|---|---|
| 4,060,866 | | 12/1977 | Robinson | 441/76 |
| 4,129,912 | | 12/1978 | Robinson | 441/76 |
| 4,985,006 | * | 1/1991 | Brunet | 441/76 |
| 5,558,553 | * | 9/1996 | Okano | 441/76 |

* cited by examiner

*Primary Examiner*—Jesus D. Sotelo
(74) *Attorney, Agent, or Firm*—Gunster, Yoakley & Stewart, P.A.

(57) ABSTRACT

A stand-up aquatic device is provided that includes at least one float member formed of a buoyant material. The float member has an upper surface and a lower surface for contacting the water. Additionally, the float member has at least one cut-through such that an end portion of the float member can be lifted to alter the shape of the lower surface of the float member so as to provide a different footprint in the water. Additionally, there is provided a float member formed of a buoyant material for use in a stand-up aquatic device. The float member includes an upper portion having an upper surface with a first shape, and a lower portion having a lower surface with a second shape, which has less surface area than the first shape. Further, a stand-up aquatic device is provided that includes at least one float member formed of a buoyant material and two pieces of flotation material. The float member has a flat upper surface and a lower surface for contacting the water, and the two pieces of flotation material attach to the ends of the upper surface of the float member to provide additional buoyancy.

15 Claims, 4 Drawing Sheets

STAND-UP AQUATIC DEVICE

BACKGROUND OF THE INVENTION

1. Field of the Invention

The present invention relates to aquatic devices, and more specifically to an aquatic device that can be operated in the standing position.

2. Description of Related Art

Water activities are an increasingly popular form of recreational activity. Consequently, there are a variety of personal aquatic devices that allow the operator to float on or move over water. Such devices include canoes, kayaks, dinghies, and windsurfers. However, these devices are generally large, difficult to store and transport, expensive to purchase, and troublesome to operate and maintain. While a variety of personal flotation devices also exist, these devices are primarily designed to maintain a body afloat and are generally inefficient for movement over water. Further, conventional aquatic devices are inefficient in maneuvering around obstructions and debris, such as rocks and floating or stationary logs.

Additionally, such devices cannot be operated in very shallow water (for example, four inches or less) or in semi-aquatic environments such as swamps, marshes, ice, snow, or mud. Therefore, conventional aquatic devices are severely limited in there uses and most can only be used in open water. Furthermore, the majority of conventional aquatic devices must be operated in the sitting position. This prevents the operator from efficiently engaging in other activities and limits the usefulness of conventional devices for rescue operations or recreational activities such as hunting.

Therefore, there is a need for an aquatic device that is superior to conventional aquatic devices for recreational purposes, as well as for use in rescue, lifesaving, and flood situations. The device should be inexpensive, versatile, lightweight, easy to store and transport, durable, and free of moving or excess parts. The device should also be amphibious to allow movement over and through a wide range of aquatic and semiaquatic environments. Additionally, the device should allow for flexibility of operator movement so that the operator can easily engage in other activities, and provide a large, buoyant surface area for carrying supplies or a rescued individual.

SUMMARY OF THE INVENTION

In view of these drawbacks, it is an object of the present invention to overcome the above-mentioned drawbacks and to provide an improved stand-up aquatic device.

One embodiment of the present invention provides a stand-up aquatic device that includes at least one float member formed of a buoyant material. The float member has an upper surface and a lower surface for contacting the water. Additionally, the float member has at least one cut-through such that an end portion of the float member can be lifted to alter the shape of the lower surface of the float member so as to provide a different footprint in the water. In a preferred embodiment, the lower surface of the float member normally has a substantially rectangular shape, but is tapered going towards one end when that end portion of the float member is lifted.

Another embodiment of the present invention provides a float member formed of a buoyant material for use in a stand-up aquatic device. The float member includes an upper portion having an upper surface with a first shape, and a lower portion having a lower surface with a second shape, which has less surface area than the first shape. In one preferred embodiment, the float member also includes at least one ridge that is attached to the lower surface of the lower portion and extends lengthwise to act as a keel.

Yet another embodiment of the present invention provides a stand-up aquatic device that includes at least one float member formed of a buoyant material and two pieces of flotation material. The float member has a flat upper surface and a lower surface for contacting the water, and the two pieces of flotation material attach to the ends of the upper surface of the float member to provide additional buoyancy. In a preferred embodiment, the two pieces of flotation material are removably attached to the upper surface of the floatation member.

Other objects, features, and advantages of the present invention will become apparent from the following detailed description. It should be understood, however, that the detailed description and specific examples, while indicating preferred embodiments of the present invention, are given by way of illustration only and various modifications may naturally be performed w out deviating from the present invention.

BRIEF DESCRIPTION OF THE DRAWINGS

FIG. 3(*a*) and 3(*b*) are diagrams respectively showing side and bottom views of the float member of FIG. 2 with the lift-up ends in the upright position;

DETAILED DESCRIPTION OF PREFERRED EMBODIMENTS

Preferred embodiments of the present invention will be described in detail herein below with reference to the attached drawings.

Figures 1, 2, 3A, 3B, 4, 5:
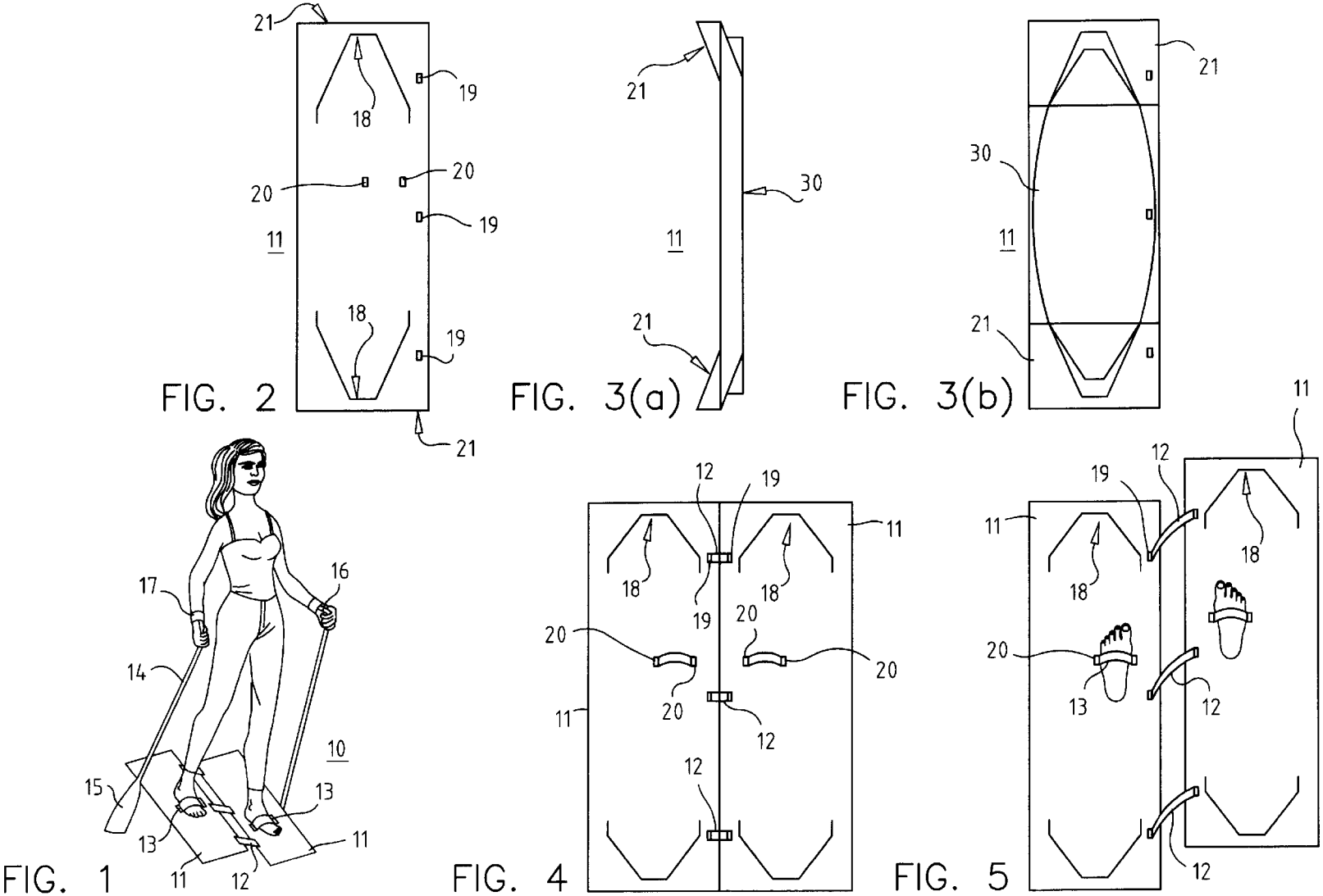
FIG. 1 is a diagram showing a stand-up aquatic device being operated by an individual in a standing position.
FIG. 2. is a diagram showing a top view of a single float member having lift-up ends in accordance with a first embodiment of the present invention.
FIG. 4 is a diagram showing a top view of two float members connected by belt ties in a tight arrangement.
FIG. 5 is a diagram showing a top view of two float members connected by belt ties in a loose arrangement.

FIG. 1 shows a stand-up aquatic device being operated by an individual. The operator stands upright and can move by using a walking motion. In this exemplary embodiment, the stand-up aquatic device includes two float members 11 that each have a generally flat, rectangular, and buoyant pontoon-like structure. The flat upper surface allows water to drain off without accumulating, and the rectangular shape provides maximum buoyancy. Preferably, each float member 11 has a length and width that is equal to the operator's height and shoulder width, respectively. In other embodiments, the float members 11 can have any general shape and can be formed in various sizes depending on the specific application.

The two float members 11 are connected together by ties 12 to add stability by preventing the float members from sliding out from underneath the operator or from sliding apart. The ties 12 can be formed by various loose or rigid materials such as belts, ropes, or wooden connecting bars. The ties 12 can be attached to the float members 11 through holes or physical connecting points or connectors. Further, the ties 12 are preferably removable to allow the operator to "walk" over a semi-aquatic surface (e.g., a marsh, swamp, snow, ice, or mud) or over fixed objects (e.g., a rock or a floating or stationary log).

A pair of foot loops 13 secure the operator to the float members 11. In the illustrated embodiment, the foot loops are placed forward of center on each float member so that the operator can lift the front ends of the float members to walk. More specifically, walking can be achieved by slightly raising the front end of a float member and sliding it forward, while dragging the rear end. Further embodiments use other types of footholds such as a rigid hold or a recessed opening. The operator uses a pair of paddles to provide additional propulsion and control. Each paddle is an oar-like structure having a shaft 14, a blade 15, an arm brace 16, and an arm rest 17.

FIG. 2 shows a top view of a single float member having lift-up ends. As shown, the float member has a generally rectangular shape and a cut-through 18 at each end. Ties can be attached to the float member through first holes 19, and foot loops can be attached through second holes 20. The float members can be constructed of any floating material such as a high density closed cell rigid plastic foam that will not absorb water (e.g., Styrofoam). The cut-throughs 18, which are preferably narrow slits cut through the height of the float member, allow the ends 21 of the float member 1I1 to be lifted so as to provide alternative bottom shapes. In the top view of FIG. 2, the ends 21 remain in the flat (or closed) position so that the undersurface of the float member 11 resembles the rectangular float member of FIG. 1.

A side view of the float member of FIG. 2 with the lift-up ends in the upright (or lifted) position is shown in FIG. 3(*a*). As shown, when the ends 21 are lifted into the upright position, the undersurface 30 of the float member 11 takes on a new shape to provide a new footprint in the water. In the illustrated embodiment, the undersurface 30 takes on a tapered or pointed (e.g., canoe-like) shape when the ends 21 are lifted, as shown by the shaded portion in the bottom view of FIG. 3(*b*). While lifting the ends decreases the buoyancy of the float members, the exposing of the pointed shape footprint to the water provides easier movement and increases speed.

Thus, the float member is easily convertible between one operating mode (i.e., ends flat) in which the maximum buoyancy and surface area of a rectangular shape gives stability, and another operating mode (i.e., ends upright) in which the characteristics of a pointedly-shaped end allow easier movement. Preferably, the ends can be lifted by hand and locked into the upright position (e.g., mechanically locked using a spacer or self-locked through side friction). In further embodiments, the float members and cut-throughs are formed such that the undersurface has other various shapes when the ends are in the flat and lifted positions. For example, the float members can be formed to alternate between wide and narrow rectangular ends, rectangular and rounded ends, or two differently-shaped pointed ends.

FIG. 4 shows a stand-up aquatic device with float members in a tight arrangement, and FIG. 5 shows the float members in a loose arrangement. In this exemplary embodiment, the two float members 1 1 are connected through belt ties 12 that are attached through the first holes 19, and foot loops 13 for securing the operator are attached through the second holes 20. In FIG. 4, the two float members 11 are held tightly together by the belt ties 12 so as to effectively form one large, buoyant platform for a wide range of aquatic activities. For example, in this arrangement, the operator can comfortably and steadily stand, sit, lie, or squat. In contrast, FIG. 5 shows the two float members 11 being held loosely together by the belt ties 12. With the belt ties 12 loose and the operator's feet secured in the foot loops 13, the operator can move each floating member independently so as to allow forward movement by walking with a normal walking gait.

Figure 6A:
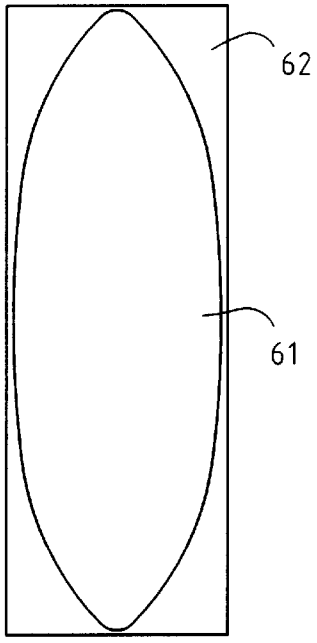
FIG. 6(*a*) and 6(*b*) are diagrams respectively showing bottom and front views of a float member according to a second embodiment of the present invention.
Figure 6B:
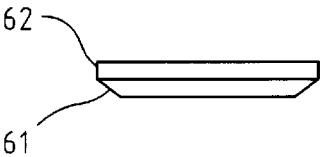

FIGS. 6(*a*), 7(*a*), and 8(*a*) depict bottom views of embodiments of float members that have differently-shaped upped and lower surfaces. FIGS. 6(*b*), 7(*b*), and 8(*b*) depict front views of the float members of FIGS. 6(*a*), 7(*a*), and 8(*a*), respectively. In the embodiment of FIGS. 6(*a*) and 6(*b*), the float member includes an upper portion 62 and a lower portion 61 that are formed as a single unit or as separate units that are securely held together (e.g., through fasteners, heating, or an adhesive). The upper portion 62 has a generally rectangular shape and the lower portion 61 has a tapered, canoe-like shape (i.e., wide in the center and pointed at the ends). The rectangular upper surface provides maximum buoyancy and surface area and the tapered underside enhances the speed and performance of the float member by exposing a generally pointed footprint to the water. In the illustrated embodiment, the lower portion 61 is also advantageously tapered from its upper surface to its lower surface, as shown in FIG. 6(*b*). In various embodiments, the relative thickness of the upper and lower portions varies according to the application.

Figure 7A:
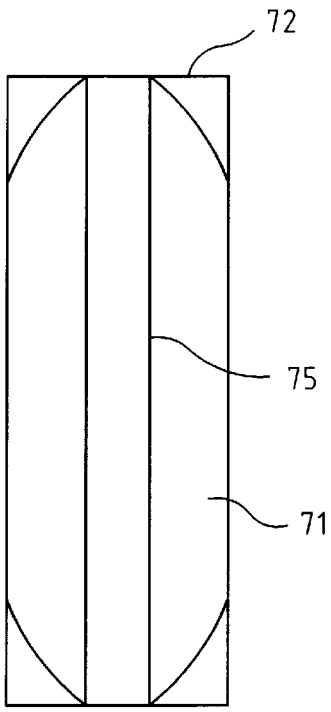
FIG. 7(*a*) and 7(*b*) are diagrams respectively showing bottom and front views of a float member according to a third embodiment of the present invention.
Figure 7B:
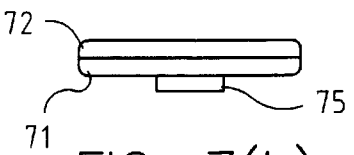

While the embodiment of FIGS. 6(*a*) and 6(*b*) has a lower portion 61 with a full canoe outline that ends at an actual point, FIGS. 7(*a*) and 7(*b*) show another embodiment in which the lower portion 71 has a partial canoe outline that is also tapered but with partially blunt ends. Further, the embodiment of FIGS. 7(*a*) and 7(*b*) has a ridge 75 that runs lengthwise down the centerline of the float member. The ridge 75 acts like a shallow keel to stabilize the floating member and help to keep it tracking in a straight line through the water. In various embodiments, the length, thickness, and width of the ridge varies according to the application, and multiple lengthwise ridges can be provided.

Figure 8A:
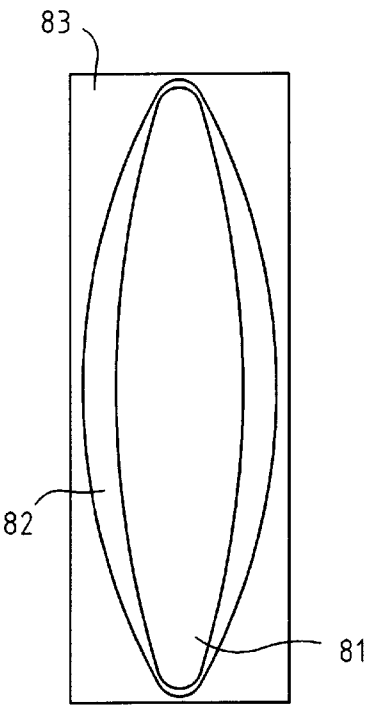
FIG. 8(*a*) and 8(*b*) are diagrams respectively showing bottom and front views of a float member according to a fourth embodiment of the present invention.
Figure 8B:
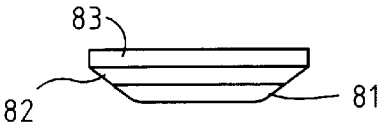

FIGS. 8(*a*) and 8(*b*) depict yet another embodiment in which the float member includes an upper portion 83, a middle portion 82, and a lower portion 81. A narrower canoe shape is formed in the lower portion 81 under a broader canoe shaped middle portion 82. The broader canoe outline of the middle portion 82 is attached under the generally rectangular upper portion 83. Thus, the embodiment of FIGS. 8(*a*) and 8(*b*) provides a generally rectangular upper surface with a double canoe outline located on the underside. In further embodiments, any number of layers can be provided, with each layer taking on any general shape (e.g., rectangular, rounded, or tapered) to form various footprints on the underside of the float member for different applications. Furthermore, these multiple layer embodiments can be provided with cut-throughs of varying depths (as described above with respect to FIGS. 2–5) to allow one float member to have alternative bottom shapes or footprints.

Figure 9A:
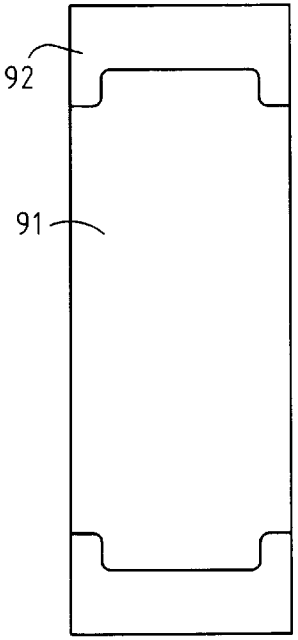
FIG. 9(*a*) and 9(*b*) are diagrams respectively showing top and front views of a float member according to a fifth embodiment of the present invention.
Figure 9B:
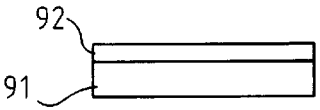
Figure 11F:
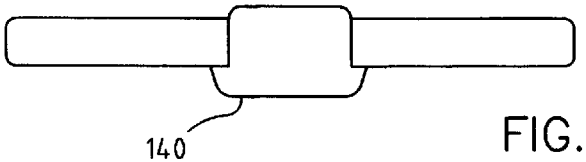
FIG. 11(*a*) to 11(*g*) are diagrams showing views of float members according to other embodiments of the present invention.
Figure 11G:
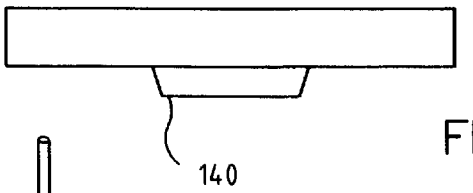

FIGS. 9(*a*) and 9(*b*) show top and front views of a float member with upper capped ends. As shown, a generally rectangular float member 91 has additional flotation material 92 (e.g., Styrofoam) attached to each end. The additional flotation material, which can be removable or securely attached, provides extra buoyancy, particularly when the operator stands forward of center. In further embodiments, the added flotation material has various sizes, thicknesses, and shapes depending on the application. Additionally, the float member can also have cut-throughs or a multiple layer construction, as described above.

Figure 10:
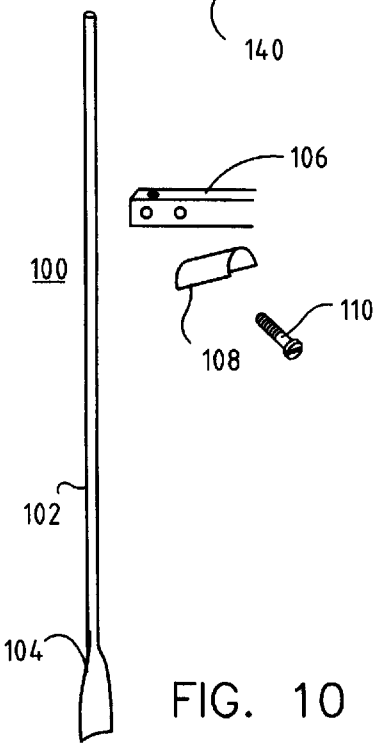
FIG. 10 is a diagram showing an exploded view of a paddle assembly.
Figure 11E:
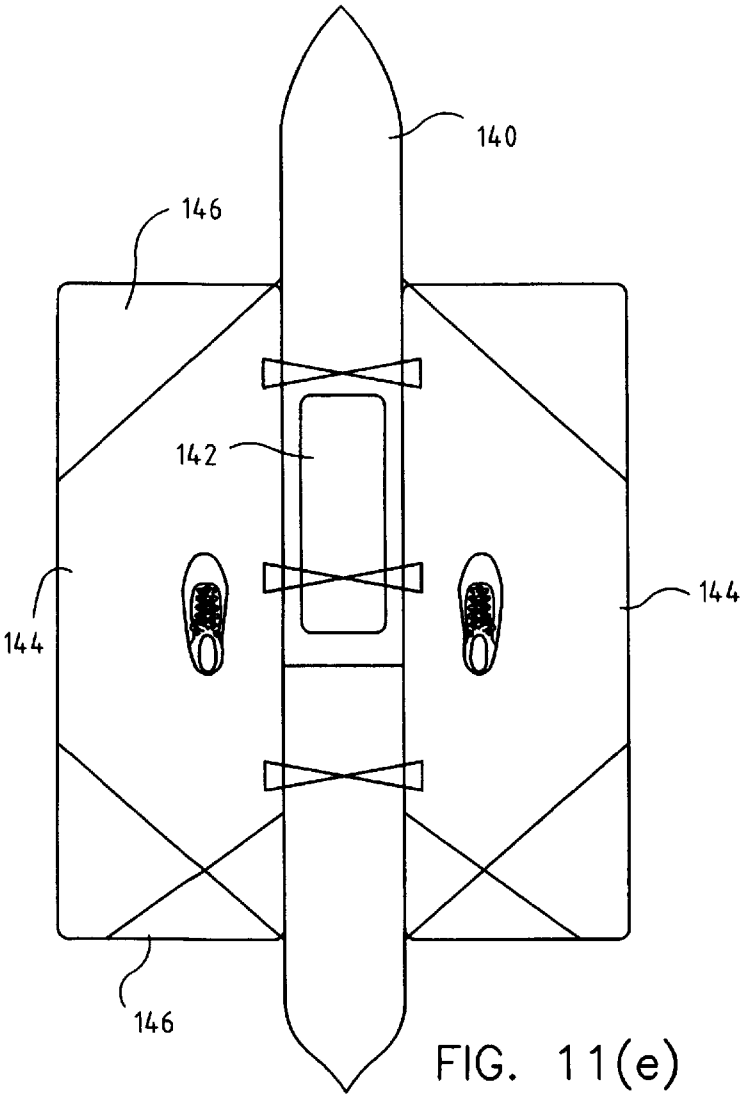
Figures 11A, 11B, 11C, 11D:
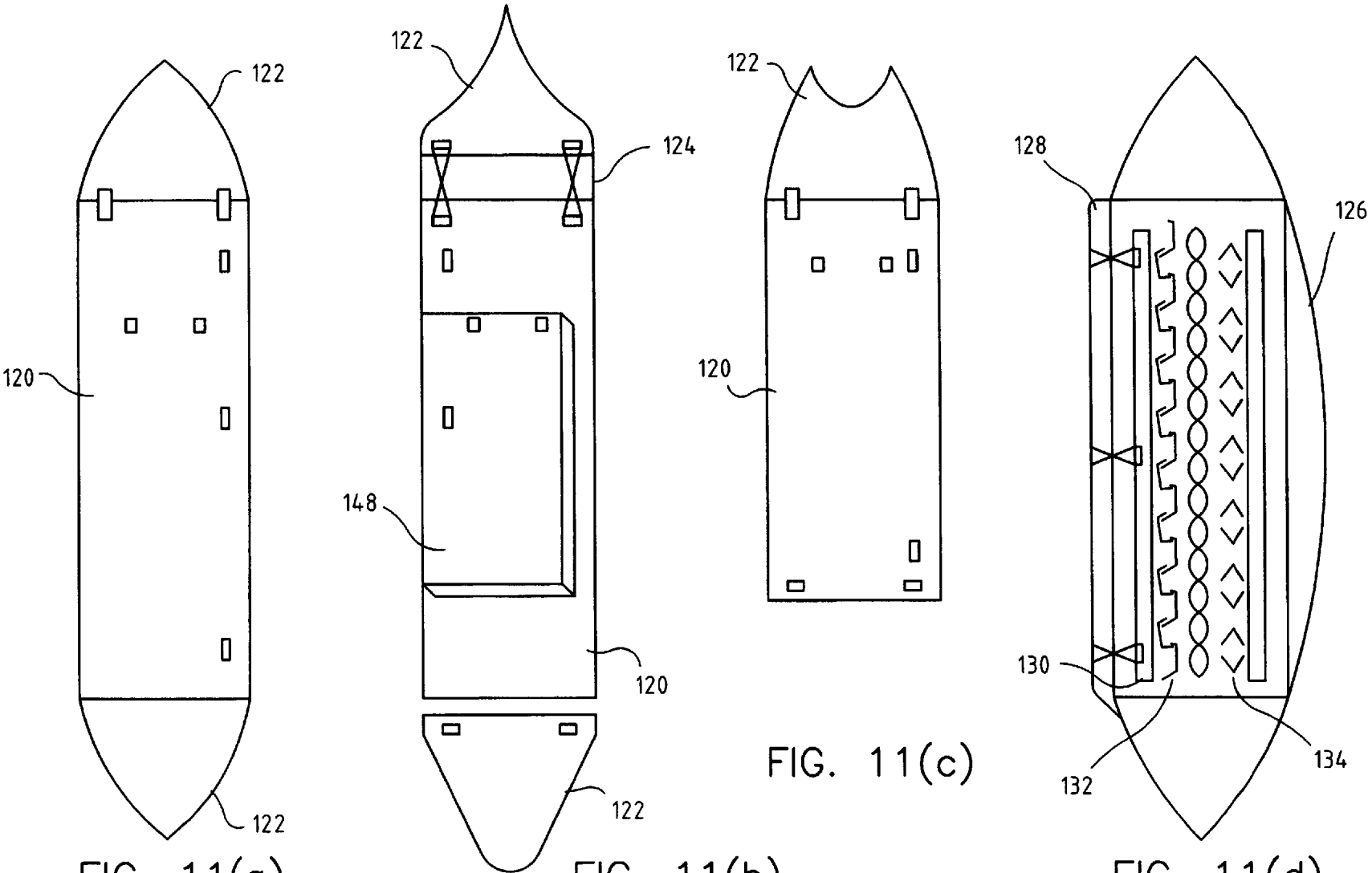

FIG. 10 shows an exploded view of a paddle assembly for use with the stand-up aquatic device. The paddle assembly 100 includes a paddle with a shaft 102 and blade 104. Attached to the upper part of the paddle is an arm brace 106, which is attached to an arm rest 108 by a fastener 10 such as a locking screw. The arm rest 108 is preferably adjustable. The arm brace and arm rest allow the operator to handle each paddle with one hand while in the standing position, in much the same way as ski poles.

The stand-up aquatic device of the present invention are particularly well suited for rescue or lifesaving operations or for use in flood situations. They can be used to easily move between wet or flooded areas and dry areas, to maneuver in water four inches deep or shallower, to easily maneuver over and around obstructions and debris, and to maneuver in tight spaces. Additionally, because the operator operates the device in the standing position, the operator can engage in other activities requiring the hands or arms, or bending or kneeling. The operator can also easily get on or off of the water shoes. Further, the close proximity of the upper surface of the device to the surface of the water allows equipment or another individual to be easily loaded onto or unloaded from the device, and the device can be designed to provide a large, buoyant surface area for transporting equipment. Preferably, each float member is designed to carry the weight of one individual, so the device can carry two people at once. Because the device can be designed to be inexpensive, durable, lightweight, and easy to store, it is well suited as a standard household item for individuals living in low-lying areas that are prone to flooding.

The stand-up aquatic device of the present invention is also well suited for physical fitness purposes. Because the device is operated in the standing position, the legs and the arms are exercised. Thus, the user can achieve a full body cardiovascular workout. Furthermore, the user can perform the exercises in an enjoyable aquatic environment. Additionally, the device can be used to test a pond or other body of water for thin ice. For example, using the device, one can walk out on the ice to see if it can accommodate the weight. If the ice breaks, the operator remains floating and can safely walk back to land.

Furthermore, the stand-up aquatic device of the present invention provides a high degree of versatility. The device is compact, easy to store, and easy to transport in a car or larger water craft. A small stool or ice chest can be added to the water shoes to allow the operator to sit. The surface area can also be used for sunbathing or carrying gear such as a backpack or hunting and fishing equipment. Additionally, several of the devices can be connected together to form a small footbridge or crawl-way. Further, features such as lift-up ends, a canoe-like shape, multiple layers, ridges on the underside, and upper capped ends add to the performance and stability of the device.

FIGS. 11(*a*) to 11(*c*) show top views of a float member having separate tips in accordance with further embodiments of the present invention. In FIG. 11(*a*), the flat member has a main body 120 and tips 122. The tips, which can vary in size, shape, and thickness, can be temporarily attached to the main body (e.g., using rope, tape, buckles, or a hinge) or permanently attached (e.g., using an adhesive). The tips 122 can be added to one or both ends of the main body 120 to increase efficiency, add buoyancy, provide greater stability, and/or to ease movement through the water.

In FIG. 11(*b*), a spacer 124 is provided between the main body 120 and the tip 122. Spacers, which can also be temporarily or permanently attached, can be used to increase the length of the float member, increase buoyancy, and increase stability. In various embodiments, spacers are attached to the top, bottom, front, and/or back of the main body. FIG. 11(*c*) shows the a single tip 122 attached to the main body 120. In these embodiments, the main body 120 is a rigid buoyancy element that provides the primary area for carrying the body weight of the user, who can be standing, sitting, or laying. The main body ties together the other elements of the float member such as tips, spacers, added flotation elements, and inserts.

FIG. 11(*d*) shows a bottom view of a float member having added flotation elements. A first curved flotation element 126 is attached to the outside area of the main body, and a second straight flotation element 128 is attached to the inside area of the main body. The added flotation elements 126 and 128 can be used to increase buoyancy, surface area, stability, and/or aesthetics. Various holes, slots, and/or notches can be provided on the main body to function as connection points for the various tips, spacers, and flotation elements.

These elements can be selectively attached to the main body by the user to flexibly adapt the float member to the operating environment and prevailing conditions. FIG. 11(*d*) also shows various other features that can be added to increase efficiency of movement in different environments. Rail skids 130 can be included to ease movement over ice surfaces and mud bogs. A tread or track 132 can be included for mud bogs, brush, or wet sand environments, and cleats or spikes 134 can be added for soft surfaces, irregular surfaces, or aquatic debris. One or more such features can be temporarily or permanently attached to the underside of the float member.

FIGS. 11(*e*) to 11(*g*) show other embodiments having an elongated main body and attached support sides. As shown, the main body 140 is a flotation element having an extended length (e.g., equal to the user's height). The sides 144, which are the primary user supports, are temporarily or permanently attached to the main body 140. The main body 140 can extend further downward as shown in FIGS. 11(*f*) and 11(*g*) to increase buoyancy, and can include a cavity 142 to provide a compartment for carrying food, gear, equipment, and the like. The shapes of the support elements 144 can be altered (e.g., as shown by the various hatching 146) to present a more streamlined footprint to the water. As shown in FIG. 11(*b*), a raised standing area can be provided to promote water runoff. Additionally, the raised area helps keep the operator dry in cold water conditions.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

What is claimed is:

1. A stand-up aquatic device comprising:

at least one float member formed of a buoyant material, the float member having an upper surface and a lower surface for contacting water, wherein the float member has at least one cut-through such that an end portion of the float member can be lifted to alter the shape of the lower surface of the float member so as to provide a different footprint in the water.

2. The stand-up aquatic device as defined in claim 1, wherein the float member has two cut-throughs, one of the cut-throughs being provided at each of the front and rear ends of the float member, when the front and rear end portions of the float member are not lifted, the lower surface of the float member has a substantially rectangular shape, and when the front and rear end portions of the float member are lifted, the lower surface of the float member has a canoe shape.

3. The stand-up aquatic device as defined in claim 1, wherein the lower surface of the float member normally has a substantially rectangular shape, and when the end portion of the float member is lifted, the lower surface of the float member is tapered going towards that end.

4. The stand-up aquatic device as defined in claim 1, wherein when the end portion of the float member is not lifted, the float member is in a first operating mode that provides maximum buoyancy, and when the end portion of the float member is lifted, the float member is in a second operating mode that provides easier movement.

5. The stand-up aquatic device as defined in claim 1, wherein two float members are provided, and said stand-up aquatic device further comprises a plurality of ties connecting the two float members together.

6. The stand-up aquatic device as defined in claim 5, wherein the ties can be adjusted to selectively provide either a tight or loose connection between the two float members.

7. A float member formed of a buoyant material for use in a stand-up aquatic device, said float member comprising:

an upper portion having an upper surface with a first shape; and a lower portion having a lower surface with a second shape, which has less surface area than the first shape, wherein the upper surface has a substantially rectangular shape and the lower surface has a shape that is tapered towards at least one end.

8. A float member formed of a buoyant material for use in a stand-up aquatic device, said float member comprising:

an upper portion having an upper surface with a first shape; and a lower portion having a lower surface with a second shape, which has less surface area than the first shape; and further comprising at least one middle portion having a third shape, which is different from the first and second shapes, wherein the lower surface and the middle portion each have shapes that are tapered towards at least one end, and the lower surface is tapered more than the middle portion.

9. A float member formed of a buoyant material for use in a stand-us aquatic device, said float member comprising:

an upper portion having an upper surface with a first shape; and a lower portion having a lower surface with a second shape, which has less surface area than the first shape, wherein the upper portion is not tapered between its upper and lower surfaces.

10. A float member formed of a buoyant material for use in a stand-up aquatic device, said float member comprising:

an upper portion having an upper surface with a first shape; and a lower portion having a lower surface with a second shape, which has less surface area than the first shape, wherein the upper portion is not tapered between its upper and lower surfaces, and wherein the lower portion is not tapered between its upper and lower surfaces.

11. A float member formed of a buoyant material for use in a stand-up aquatic device, said float member comprising:

an upper portion having an upper surface with a first shape; and a lower portion having a lower surface with a second shape, which has less surface area than the first shape, further comprising at least one ridge attached to the lower surface of the lower portion, the ridge extending lengthwise to act as a keel, wherein the ridge is attached down the centerline of the lower surface of the lower portion.

12. A stand-up aquatic device comprising:

at least one float member formed of a buoyant material, the float member having a flat upper surface and a lower surface for contacting water; and two pieces of flotation material each attach to one end of the upper surface of the float member to provide additional buoyancy.

13. The stand-up aquatic device as defined in claim 12, wherein the two pieces of flotation material are removably attached to the upper surface of the floatation member.

14. The stand-up aquatic device as defined in claim 12, further comprising additional flotation material removably attached to the two pieces of flotation material for further increasing buoyancy.

15. The stand-up aquatic device as defined in claim 14, wherein the two pieces of flotation material are removably attached to the upper surface of the floatation member.

* * * * *